United States Patent [19]

Towery

[11] Patent Number: 4,707,400

[45] Date of Patent: Nov. 17, 1987

[54] THICKENING OF WATER-COAGULABLE SOLVENT COATING SOLUTIONS

[75] Inventor: Donald R. Towery, Pleasant Garden, N.C.

[73] Assignee: Burlington Industries, Inc., Greensboro, N.C.

[21] Appl. No.: 903,130

[22] Filed: Sep. 3, 1986

[51] Int. Cl.[4] ..... B32B 7/00

[52] U.S. Cl. ..... 428/260; 427/246; 428/265; 428/290; 428/315.5; 428/913; 428/423.1

[58] Field of Search ..... 428/290, 913, 315.5, 428/315.7, 315.9, 904, 260, 423.1, 913, 265; 427/246; 521/62, 137

[56] References Cited

U.S. PATENT DOCUMENTS

| | | | |
|---|---|---|---|
| 4,029,534 | 6/1977 | Bocks et al. | 156/246 |
| 4,282,285 | 8/1981 | Mohudden | 428/315.5 |
| 4,429,000 | 1/1984 | Naka et al. | 428/265 |

FOREIGN PATENT DOCUMENTS 0762179 3/1971 France .

OTHER PUBLICATIONS

"Recent Developments in Coated Apparel", by Robert Lomax, *Journal of Coated Fabrics,* vol. 14, Oct. 1984, pp. 91–99.

Data Sheets from Morton Thiokol's Texthane Products Including Product Information for Texthane 420C and 620C.

*Primary Examiner*—James J. Bell

*Attorney, Agent, or Firm*—Nixon & Vanderhye

[57] ABSTRACT

Water vapor permeable yet waterproof coated fabrics are prepared by applying a polyurethane resin solvent solution to a base fabric then immersing the coating to coagulate the resin leaving a thin, microporous coating on the fabric. An acrylic acid thickener system is included in the resin solution to provide moisture vapor transmission rates of at least 600 g/m$^2$/24 hrs and hydrostatic pressure resistance of at least 10 psi.

5 Claims, No Drawings

THICKENING OF WATER-COAGULABLE SOLVENT COATING SOLUTIONS

BACKGROUND OF THE INVENTION

This invention relates to an improved resin-containing coating solution which, when applied as a solvent-based resin solution to a fabric substrate and processed to coagulate the resin, results in a waterproof, microporous, moisture vapor permeable fabric. In particular, this invention relates to a thickener system for such resin-containing coating solutions.

Waterproof, moisture-permeable coated fabrics with good hand for use in clothing such as raincoats, work clothes, tents, canvas shoes, and raingear, made by a wet coagulation method, are described in U.S. Pat. No. 4,429,000. In that method, a water-miscible polar organic solvent solution of a resin such as polyurethane is applied to a base fabric which is then immersed in a water bath to coagulate the resin from the solution and deposit a thin, microporous, waterproof yet water vapor permeable layer on the fabric. Typical coating solutions contain a resin, usually a polyurethane elastomer, and optionally a water repellent agent, a thickener, a surfactant and possibly other adjuvants, all dissolved in a water-miscible polar organic solvent such as dimethylformamide, N-Methyl-2-Pyrrolidone dimethylacetamide or dimethylsulfoxide. The coagulating bath contains water and with up to 20% by weight of the same or a compatible polar solvent.

Coating viscosity must be carefully controlled to adjust penetration and interstitial strike-through, especially on loosely-woven and textured fabrics.

When coating textile fabric with a resinous material dissolved in a liquid medium, final distribution of the dried coating depends on several factors, including the coating method, fabric geometry, and coating viscosity. In many situations, coating viscosity is the variable most easily manipulated to control coating distribution. When dealing with true solution coatings, the solute molecular weight, solute concentration, and nature of the solvent have an influence on coating viscosity. However, optimum physical and handling properties of the coating are often obtained within specific ranges of molecular weight and polymer concentration. Application techniques can also severely limit solvent choices. With these practical operational constraints, a viscosity control additive is required.

Traditional thickeners for such resin-containing solutions are natural and modified gums, solvent-interactive fillers, and high molecular weight synthetic polymers. The choice of thickening agent has traditionally been made on the basis of compatibility, coating performance requirements and economics.

It is an object of this invention to provide a convenient, reliable thickener system providing the required ease of processing without distracting from the desired physical properties of the finished product. Water-coagulable coatings for textiles must exhibit coagulation rates within relatively narrow limits to maintain reproducible fabric properties. Candidate thickeners must have little or no effect on coagulation rates. Disclosed is a thickener system that satisfies these various requirements.

SUMMARY OF THE INVENTION

Disclosed is a process for preparing a waterproof, water vapor permeable coated fabric, exhibiting a good hydrostatic resistance of at least 10 psi, and formed in a rapid and reproducible manner by coagulation from a solvent solution of a polyurethane elastomer. The fabric is coated using the wet coagulation method, in which a polymeric elastomer, or mixture of polymeric elastomers, is dissolved in a water-miscible polar organic solvent. The polymer solution is coated onto a base fabric and then immersed in a coagulation water bath. The water extracts the polar organic solvent, which is itself water-miscible, leaving a porous polyurethane matrix having the specified porosity and other properties, on the base fabric. Additional washing to remove any unextracted polar organic solvent and drying follow. Optionally a water repellent fluorocarbon finish is later applied. A convenient thickener system, based on acrylic acid polymers that are compatible with the solvent/polyurethane system and soluble in the solvent, is used to control and adjust coating solution viscosity which, in turn, leads to thin, flexible polyurethane elastomer coatings having the optimum performance and customer acceptance properties. Most desirable coatings, when applied, are adjusted with the disclosed acrylic acid thickener system to have a viscosity in the range of at least 6000 cps, the required viscosity being higher, the more open the fabric structure. The acrylic acid polymer thickener system has a molecular weight in the range of about 450,000 to about 4,000,000 and is preferably based upon a combination of two different acrylic acid polymers having different molecular weights from within the designated range.

DETAILED DESCRIPTION OF THE INVENTION

When water is used to coagulate a polymer coating solution in the wet coagulation method, the polymer is usually dissolved in a water-miscible organic solvent. This coating solution can be applied to a textile fabric by conventional methods, such as knife over roll coating or other coating machine, and when the coated fabric is introduced to a water bath, the water soluble solvent migrates into the water bath. As the solvent is extracted from the polymer solution, the polymer precipitates. Since this precipitation occurs incrementally and simultaneously with a reduction in coating volume due to solvent being leaches into the water, a porous polymer matrix develops. Physical properties of the deposited coating can be varied by changing the coagulation rate. Coagulation bath temperature, polymer/solvent ratio, polymer solution additives, and coagulation bath additives are major factors in controlling coagulation rates.

When a thin, water coagulated urethane coating is applied to a light weight, high count fabric, a waterproof, moisture vapor permeable fabric with good resistance to hydrostatic pressure is obtained.

It has been determined by experimentation that several candidate thickeners and thickening systems are ineffective and/or unsuited for reliable control of coating viscosity. Thickeners such as polyvinyl pyrrolidone, wood flour, modified cellulosic gums, fumed silica, hydrophilic silica, and hydrophobic silica all proved to be unsuited. After unsuccessfully examining several such thickeners, a series of acrylic acid-based polymers are determined to be most suited for this application. Preferred are the Carbopol resins, which are soluble in both water and in a water-miscible polar organic solvent such as dimethylformamide (DMF), and readily thicken upon addition of a base.

Carbopol resins are manufactured by B. F. Goodrich and are currently offered in six variations. These resins are acrylic acid polymers crosslinked with a polyalkenyl polyether and have an equivalent weight of 76. The resins most suited for thickening water-coagulable solvent coatings are: Carbopols 934, 940, and 941, with molecular weights of 3,000,000, 4,000,000 and 1,250,000 respectively. These resins dissolve in DMF to yield viscous, turbid solutions; apparently enough dimethylamine to present in DMF to partially neutralize the Carbopol resins. Carbopol 934 and 940 apparently are similar in structure, but the higher molecular weight of Carbopol 940 results in a higher viscosity. Carbopol 941 is different from the other two in that despite its lower molecular weight it is an extremely efficient thickener at low concentrations and has a somewhat stringy rheology.

The supplier, B. F. Goodrich, recommends several secondary and tertiary amines for neutralization to obtain optimum performance with DMF. Of these, di-(2-ethylhexyl)amine was used at a much lower amount than that recommended by the manufacturer. B. F. Goodrich recommends 2.5 parts of di-(2-ethylhexyl)amine per part of Carbopol for neutralization; it was found that in DMF, only 0.5–0.75 part was necessary for maximum viscosity development.

In order to obtain the best balance of properties required, a 50/50 blend of Carbopol 941 (the more viscous but stringer polymer) and Carbopol 934 may be used; higher viscosity yields are obtained with blends of Carbopol 941 and 940.

The coating solutions of the present invention are based upon urethane resins dissolved in a water-miscible, polar solvent. A preferred series of polyurethane resins are Texthane 620C and 420C, available from Morton Chemical division of Morton Thiokol. Both are formulated for use in the coagulation coating process. These are one-component aromatic polyester-based urethane resins, 620C characterized as a soft resin and 420C as a firm resin; both are sold as DMF solutions whose physical and performance properties are as follows:

| | 620C | 420C |
|---|---|---|
| Dry Content, % | 30 ± 1 | 35 ± 1 |
| Viscosity at 25° C., cps | 60,000–80,000 | 130,000–170,000 |
| Dry Film Characteristics: | | |
| 100% Modulus, kg/cm$^2$ | 80 | 100 |
| 300% Modulus, kg/cm$^2$ | 280 | 340 |
| Tensile Strength, kg/cm$^2$ | 600 | 600 |
| Elongation, % | 550 | 400 |
| Brittle Point, °C. | −65 | −55 |
| Shore A Hardness | 80 | 90 |

Other components of the coating compositions include nonionic surfactants such as the Pluronic polyols, which are surface active materials manufactured by BASF-Wyandotte, and are block copolymers of propylene oxide and ethylene oxide. The polyoxypropylene serves as hydrophobe and the polyoxyethylene as lipophobe. As with the acrylic acid component, a mixture of two of these nonionic surfactants gives the best results. Average molecular weight for the Pluronic L-35 is 1900, with polyoxypropylene equal to 50 weight percent. Pluronic F-68 has an average molecular weight of 8350 with the polyoxypropylene equal to 20 weight percent.

The water-miscible polar organic solvent of choice is N,N-dimethylformamide, commonly referred to as DMF (CAS registry number 68-12-1), although other compatible solvents such as dimethylacetamide or dimethysulfoxide may be considered.

An amine is preferably added to neutralize the polyacrylic acid resin and several amines may be useful; however, best results were obtained with di(2-ethylhexyl)amine or with polyoxyethylene(15)octadecylamine (available as Ethomeen C/25 from Armak Chemicals Division of Akzo Chemie America).

RANGES AND AMOUNTS OF INGREDIENTS

Each of the above-named components is included in the water-coagulable coating compositions as follows:

| | |
|---|---|
| Urethane resin(s) | Up to 48% |
| Nonionic surfactant(s) | Up to 8% |
| Water | Up to 6% |
| Acrylic acid thickener | Up to 1% |
| Amine | Up to 0.15% |
| Water-miscible polar organic solvent | Balance |

It will be understood that the coating composition may contain any of the usual coating additives and adjuvants such as a pigment or colorant, water repellant, antistat, etc. The quantities of each of these ingredients may be varied depending upon the result desired, for instance depending on the coating viscosity and total solids requirements. Each of the above-listed ingredients must be present in the minimum amount indicated or, if an optional ingredient, must be present in an amount of at least 0.1%. All parts and percentages herein are expressed by weight unless otherwise indicated. The minimum viscosity of the coating material, when applied to the base fabric, is 500 cps.

Performance requirements for urethane-coated fabrics will vary depending upon the application or end use to which the fabric is exposed. As a point of reference, and without particular limitation, a typical urethane-coated nylon taffeta for use in constructing sportswear will have the following minimum values:

| | |
|---|---|
| Moisture vapor transmission rate (g/m$^2$/24 hours) | 600 |
| Hydrostatic pressure resistance (psi) | 10 |

The coating solutions are prepared and then applied to the fabric substrate according to the following procedure:

PREPARING A THICKENER IN LIQUID FORM

The Carbopol acrylic acid-type resins are supplied as dry powders of very low apparent density and are prone to dust and float around the working area. To minimize this inconvenience, it has been found convenient to prepare a stock solution in DMF. The Carbopol resin and DMF are pre-weighed separately and the Carbopol is slowly sifted into rapidly agitated DMF, with stirring continued until no gel structure is evident. As this point, the Carbopol resin is neutralized to achieve maximum viscosity. A stock solution so prepared appears to have extended shelf life.

PREPARING THE FABRIC COATING

The urethane resin or mixture of resins and the previously prepared Carbopol solution are pre-weighted into a container. Water, DMF, and surfactant are weighed into a separate container and added to the urethane/-Carbopol blend with sufficient agitation to maintain good turnover of the viscous resin blend. At this point any colorant required is added, and stirring is continued until homogeneity is obtained.

APPLYING THE COATING COMPOSITION TO THE FABRIC

The thickened urethane coating solution is applied to any textile substrate capable of supporting the liquid film by any appropriate conventional coating method. The coated fabric is then dipped in a coagulation bath consisting of water, or water and and additive to alter coagulation rate, e.g. DMF; surfactant, etc. During this dipping step, the majority of the DMF in the DMF/urethane film migrates into the coagulation bath and is replaced by water. The very low percentages of water in the film dilute the DMF concentration sufficiently to initiate precipitation of the urethane, generating a water-vapor-permeable but waterproof, microporous, spongy film. The coated fabric is given additional washing to remove all the DMF; residual DMF would redissolve the urethane on drying and collapse the microporous structure. The coated and washed fabric is subsequently dried and given a water repellent finish in a separate application step.

PERFORMANCE CHARACTERISTICS AND EVALUATIONS

The following examples evaluate various coated fabrics as to moisture vapor transmission rate (MVTR) measured according to ASTM E96-80, Procedure A; Mullen Hydrostatic Resistance (MH) measured according to ATM D751-79; and coating weight (CW) measured as ounces of coating applied per square yard.

The invention is further illustrated by the following non-limiting examples in which all parts and percentages are reported by weight.

EXAMPLE 1 AND COMPARATIVE EXAMPLE A

Coating mixture (A) was prepared by mixing a previously prepared acrylic acid thickener solution in DMF with a mixture of urethane resins, nonionic surfactant and diluents; a similar formulation (B) was prepared but without the acrylic acid thickener and thus not according to the present invention. The formulations, expressed in percent by weight, were:

| | A | B |
|---|---|---|
| Urethane resin (Texthane 620-C) | 29.7 | 29.7 |
| Urethane resin (Texthane 420-C) | 25.4 | 25.4 |
| Nonionic surfactant (Pluronic L-35) | 2.0 | 2.0 |
| Acrylic acid thickener (Carbopol 941 2% in DMF) | 6.0 | — |
| DMF | 36.9 | 42.9 |

Total solids of coating solution A was 17.9%. Coating solutions A and B were applied to a textured polyester taffeta by knife over roll coating, washed, dryed and treated with a fluorocarbon/silicon water repellent. the following results were obtained.

| | A | B |
|---|---|---|
| Viscosity (cps) | 27,000 | 2,750 |
| Moisture vapor transmission rate ($g/m^2/24$ hours) | 1,434 | 1,281 |
| Hydrostatic resistance (psi) | 24 | 30 |
| Coating weight ($oz/yd^2$) | 0.56 | 0.58 |

EXAMPLE 2

The following coating composition, expressed in percent by weight, was prepared:

| | |
|---|---|
| Urethane resin (Texthane 620-C) | 47.8 |
| Nonionic surfactant (Pluronic F-68) | 3.8 |
| DMF | 43.6 |
| Acrylic acid thickener (Carbopol 934 2% in DMF): | 4.8 |
| Total solids | 18.2% |

This formulation was applied to a textured polyester taffeta fabric in the manner of Example 1 and evaluated with the following result:

| | |
|---|---|
| Viscosity (cps) | 4,350 |
| Moisture vapor transmission rate ($g/m^2/24$ hours) | 1,533 |
| Hydrostatic resistance (psi) | 20 |
| Coating weight ($oz/yd^2$) | 0.41 |

EXAMPLE 3

In this example a coating composition containing a mixture of acrylic acid thickeners and having the following formulation was prepared in the manner as previously described:

| | |
|---|---|
| Urethane resin (Texthane 620-C) | 28.3 |
| Urethane resin (Texthane 420-C) | 24.2 |
| Nonionic surfactant (Pluronic L-35) | 2.0 |
| DMF | 30.0 |
| Acrylic acid thickener (2% Carbopol 940/941 50:50 in DMF) | 7.5 |
| Total Solids | 19.0 |

This coating composition was applied to a flat nylon taffeta in the manner of Example 1 and a sample evaluated with the following results:

| | |
|---|---|
| Viscosity (cps) | 23,000 |
| Moisture vapor transmission rate ($g/m^2/24$ hours) | 1,294 |
| Hydrostatic resistance (psi) | 28 |
| Coating weight ($oz/yd^2$) | 0.59 |

As a class, the acrylic acid resins provide reliable, easy-to-process, thickened DMF/urethane coating compositions with the requisite coating and penetration properties, and the ability to coagulate with the urethane resin or resin system when introduced into the water coagulation bath while maintaining the desired microporous structure. The resulting coating is not water sensitive in that it withstands multiple machine launderings.

What is claimed is:

1. A process of making a waterproof, water vapor permeable coated fabric having a microporous polyurethane layer thereon formed by the wet coagulation method, said process comprising applying a water-miscible, polar organic solvent solution of a polyurethane elastomer to a base fabric, immersing the thus-coated base fabric into an aqueous coagulation bath to extract the solvent from the polymer solution leaving a porous polyurethane matrix adhered to the base fabric, then washing and drying the coated fabric to produce a microporous, water vapor permeable polyurethane layer thereon, the improvement in which the polar organic solvent solution of polyurethane elastomer contains an acrylic acid thickener the polyurethane elastomer coating, when applied to the base fabric, has a viscosity of at least 500 cps, and the resulting microporous polyurethane layer has a moisture vapor transmission rate of at least 600 grams/square meter/ 24 hours and a hydrostatic pressure resistance of at least 10 psi.

2. The process of claim 1 in which the polyurethane elastomer coating, when applied to the base fabric, has a viscosity of at least 6,000 cps.

3. The process of claim 1 in which the polar organic solvent is dimethylformamide and the acrylic acid polymer thickener is soluble in dimethylformamide and has a molecular weight in the range of from about 1,000,000 to about 4,000,000.

4. The process of claim 3 in which a mixture of two acrylic acid polymers each having different molecular weights and both soluble in dimethylformamide are used as the thickening agent.

5. A waterproof, water vapor-permeable coated fabric having a urethane coating with a moisture proof transmission rate of least 600 $g/m^2/24$ hrs. And a hydrostatic pressure resistance of least 10 psi.

* * * * *